US008262542B2

(12) United States Patent
Pinamonte

(10) Patent No.: US 8,262,542 B2
(45) Date of Patent: Sep. 11, 2012

(54) STRENGTHENING DEVICE FOR LEG MUSCLES

(76) Inventor: Gianandrea Pinamonte, Verona (IT)

( * ) Notice: Subject to any disclaimer, the term of this patent is extended or adjusted under 35 U.S.C. 154(b) by 271 days.

(21) Appl. No.: 12/830,303

(22) Filed: Jul. 3, 2010

(65) Prior Publication Data

US 2011/0003667 A1 Jan. 6, 2011

(30) Foreign Application Priority Data

Jul. 6, 2009 (IT) ..... VR2009A0098

(51) Int. Cl.
*A63B 23/08* (2006.01)

(52) U.S. Cl. ..... 482/80; 482/51; 482/79

(58) Field of Classification Search ..... 482/51, 482/53, 54, 79, 80; 434/247
See application file for complete search history.

(56) References Cited

U.S. PATENT DOCUMENTS

| | | | | |
|---|---|---|---|---|
| 3,472,508 | A | 10/1969 | Baker | |
| 3,641,601 | A | 2/1972 | Sieg | |
| 4,253,661 | A | 3/1981 | Russell | |
| 4,422,635 | A * | 12/1983 | Herod et al. | 482/80 |
| 6,371,894 | B1 | 4/2002 | Hill | |
| 7,635,321 | B2 * | 12/2009 | Hill et al. | 482/79 |
| 7,824,315 | B2 * | 11/2010 | Piaget et al. | 482/53 |
| 2003/0207738 | A1 | 11/2003 | Wong | |
| 2008/0248934 | A1 | 10/2008 | Gianandrea | |

FOREIGN PATENT DOCUMENTS

WO 02066116 A1 8/2002

OTHER PUBLICATIONS

Search Report issued by European Patent Office on behalf of the IT-PTO in connection with Italian Conventional Patent Application No. VR2009A000098 dated Feb. 25, 2010, 7 pages.

* cited by examiner

*Primary Examiner* — Glenn Richman

(74) *Attorney, Agent, or Firm* — Stephen B. Salai; Brian B. Shaw; Harter Secrest & Emery LLP

(57) ABSTRACT

The present invention relates to a device for strengthening leg muscles having a substantially flat support surface, an external work surface, a front, a back and two flanks, the strengthening device further comprising at least one relief portion proximal to said back and distal from said front.

22 Claims, 7 Drawing Sheets

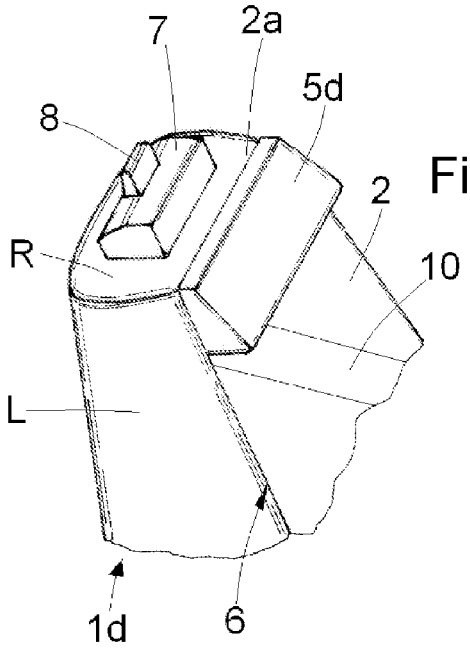
Fig. 7
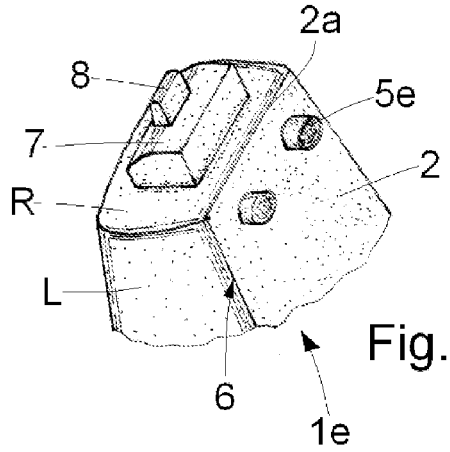
Fig. 8
Fig. 6
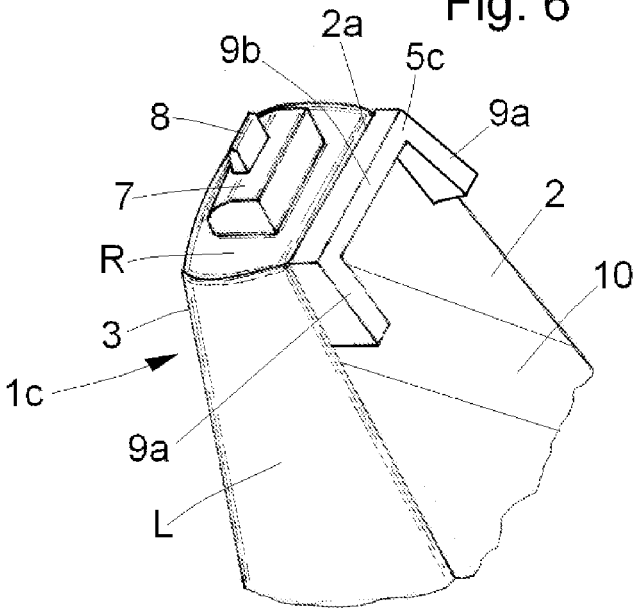
Fig. 16b
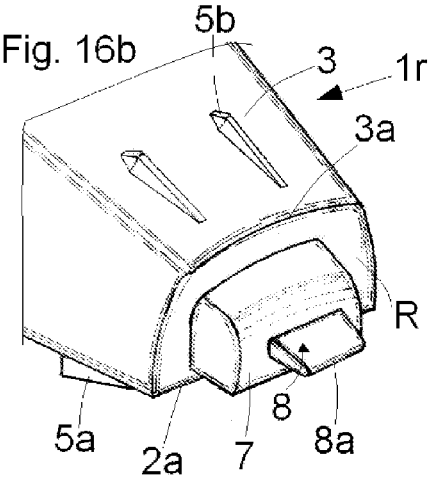
Fig. 16a
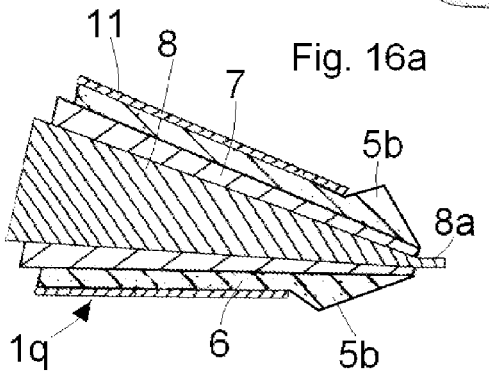

12
12a
12b
13
13a
14
14a
14b
14c
14d
15
16
17a
17b
18
18a
19
120
XXI
XXII

STRENGTHENING DEVICE FOR LEG MUSCLES

FIELD OF INVENTION

The present invention regards a strengthening device which can in particular be used in combination with a drum pedal, so as to allow a drummer to strengthen his leg muscles, particularly all the rear muscles of the lower limbs, affecting all of the tendon-muscular bands from the foot to the gluteus.

BACKGROUND OF THE INVENTION

Up to now, various types of strengthening devices for the leg muscles have been proposed, including the device according to US patent application US-2008248934 in the name of the applicant of the present patent application. Such device comprises a body having a ground support surface and a work surface, which are articulated to each other such that they can be angularly and mutually moved around a horizontal (in use) rotation axis.

In use, the user applies pressure on the work surface, either directly or via interposition of a drum peddle, in order to cause its angular movement around the horizontal axis with respect to the support surface.

The compression force applied by the user, in use, has a horizontal component, however, which can cause horizontal slipping or movement of the device itself. Hence the user, after having carried out repeated compression and release steps of the work surface for a certain time period, must interrupt the training and correctly reposition the device under his own foot or under the pedal.

SUMMARY OF THE INVENTION

An object of the present invention is then to provide a strengthening device for leg muscles that remains stably in position in use, even for long periods of use.

Another object of the present invention is to provide a device which is adaptable or adjustable to different operating conditions.

Another object of the present invention is to provide a mounting unit for a leg muscle strengthening device suitable for users with quite different muscular structures.

Another object of the present invention is to provide a mounting unit for a leg muscle strengthening device that, if located beneath a drum pedal, can be used by drummers who carry out very different feet movements when they play.

Another object of the present invention is to provide a strengthening device to be arranged in work position beneath a drum pedal and also be removed from such arrangement in an easy manner, hence without having to carry out complex operations or employ tools.

These and still other objects, which will be clearer below, are achieved by a device for strengthening leg muscles having:

a substantially flat support surface and an external work surface directly engageable by the foot of a user or by a plate of a drum pedal, the support and work surfaces being articulated with each other at a respective articulation end, so that they can be mutually and angularly moved between at least one compression position and at least one release position, and a front, a back and two flanks, the cross section of the device decreasing in the front-to-back direction, the articulation end being arranged at the back, the strengthening device comprising at least one relief portion at the articulation end thereby resulting proximal to the back and distal from the front, the at least one relief portion:

extending towards the exterior of the device from at least one between the support surface and the work surface, being made integrally with the respective support surface or work surface, and and being made of resiliently deformable material, whereby the at least one relief portion is movable between an extended rest position and a compressed position close to a respective support surface or work surface, in which it induces reaction forces which are opposed to the device slipping due to the horizontal component of the compressive force applied to the device by a user, directly or with the interposition of a drum pedal, when the support surface and the work surface are mutually angularly moved between at least one a compression position and at least one release position.

BRIEF DESCRIPTION OF THE DRAWING FIGURES

Further aspects and advantages of the present invention will be clearer from the following detailed description of specific embodiments of a strengthening device, such description being made with reference to the accompanying drawings, in which:

FIGS. 6 to 8 are similar views to FIG. 2 of the same number of embodiments of a strengthening device according to the present invention;

Figures 17, 18, 19, 20, 21, 22, 23, 24, 25, 25A:
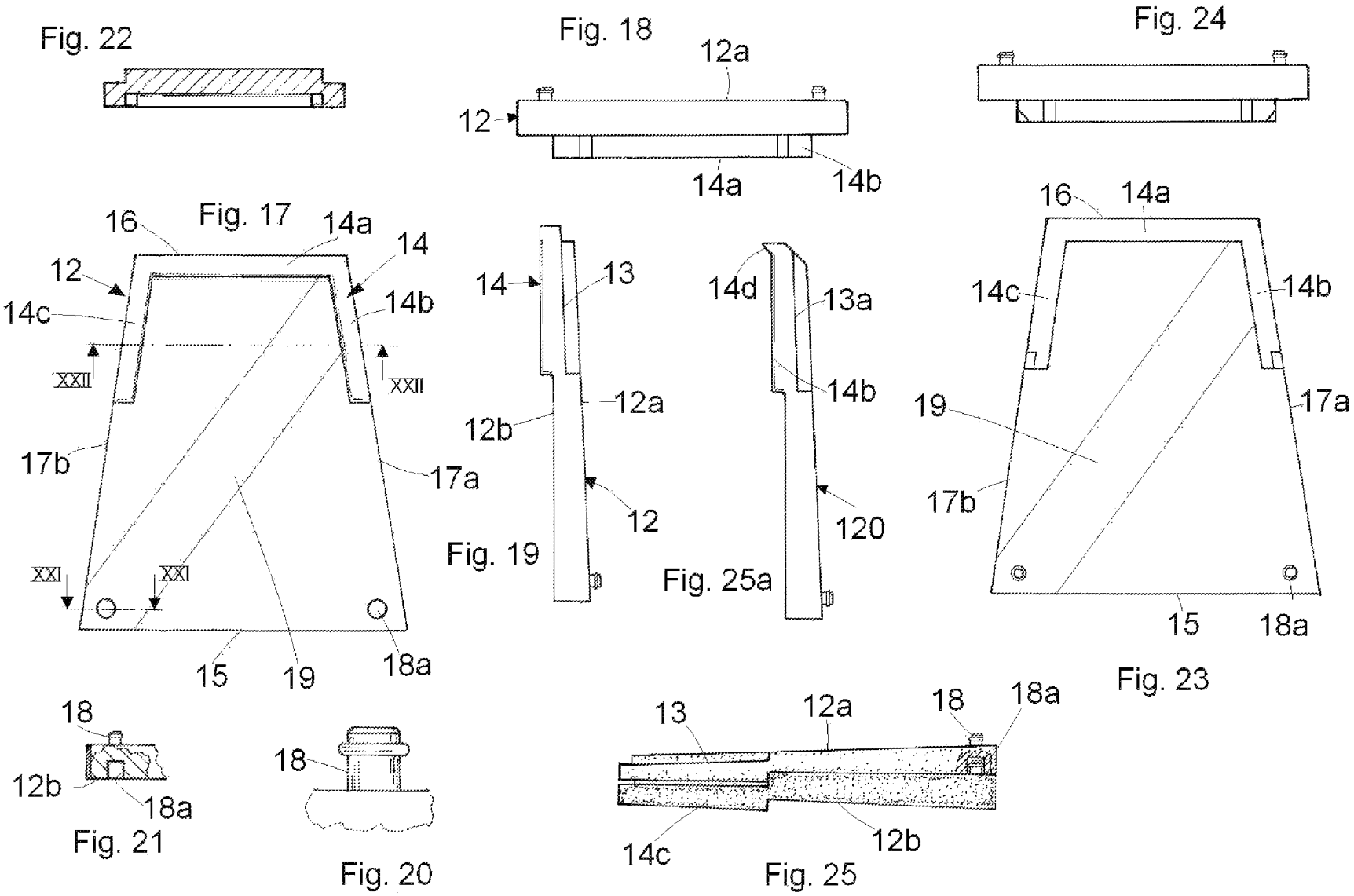
FIGS. 17, 18 and 19 are plan, front and side views, respectively, of a pedestal component for a strengthening device according to the present invention.
FIG. 20 is a view of a detail of the pedestal component of FIGS. 17 to 19.
FIGS. 21 and 22 are cross-section views taken along the lines XXI-XXI and XXII-XXII, respectively, of FIG. 16.
FIGS. 23 and 24 are plan and front views, respectively, of another embodiment of pedestal component according to the present invention.
FIG. 25 is a sectional side view of two assembled pedestal components.
Figure 26:
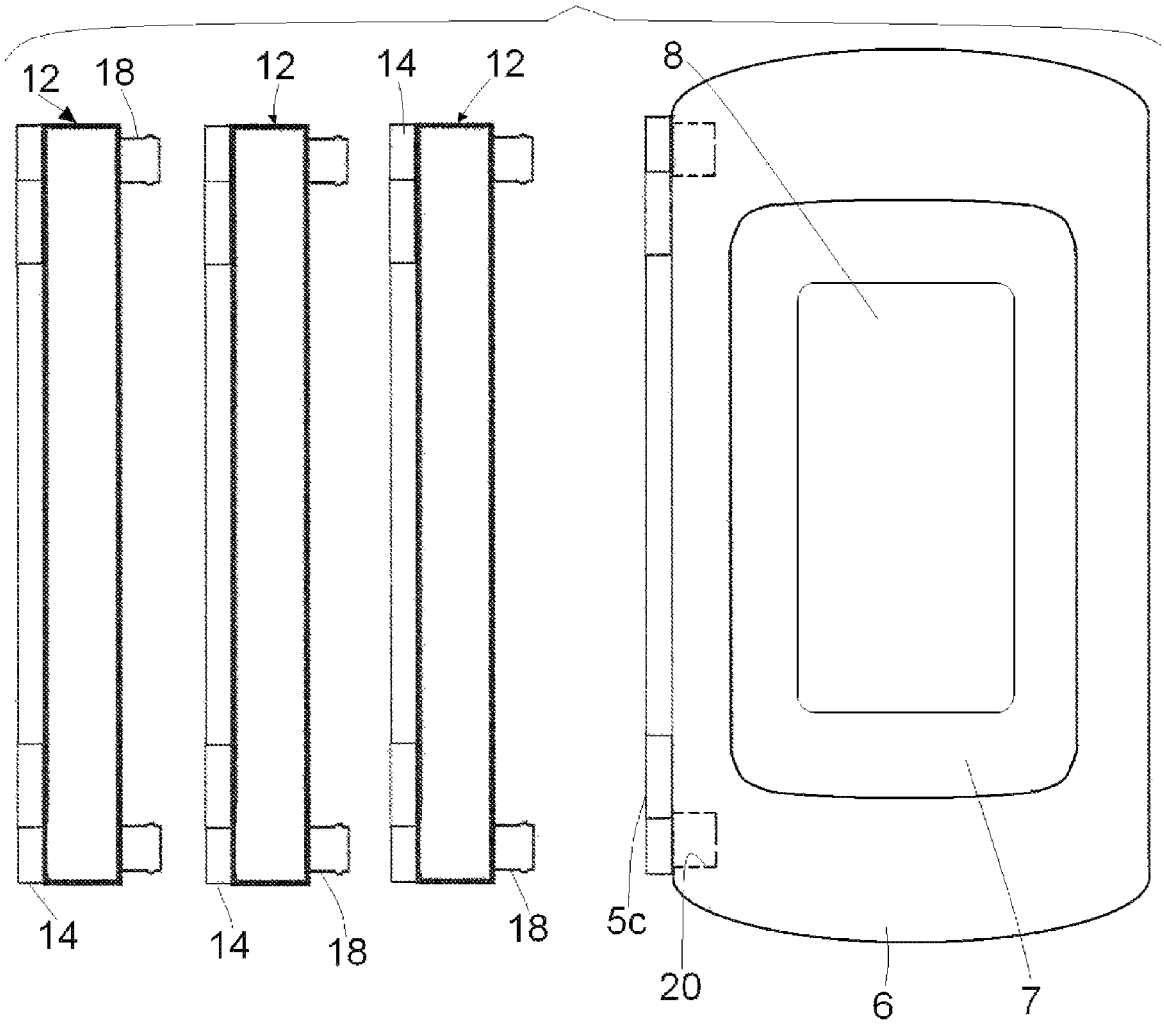
Figure 27:
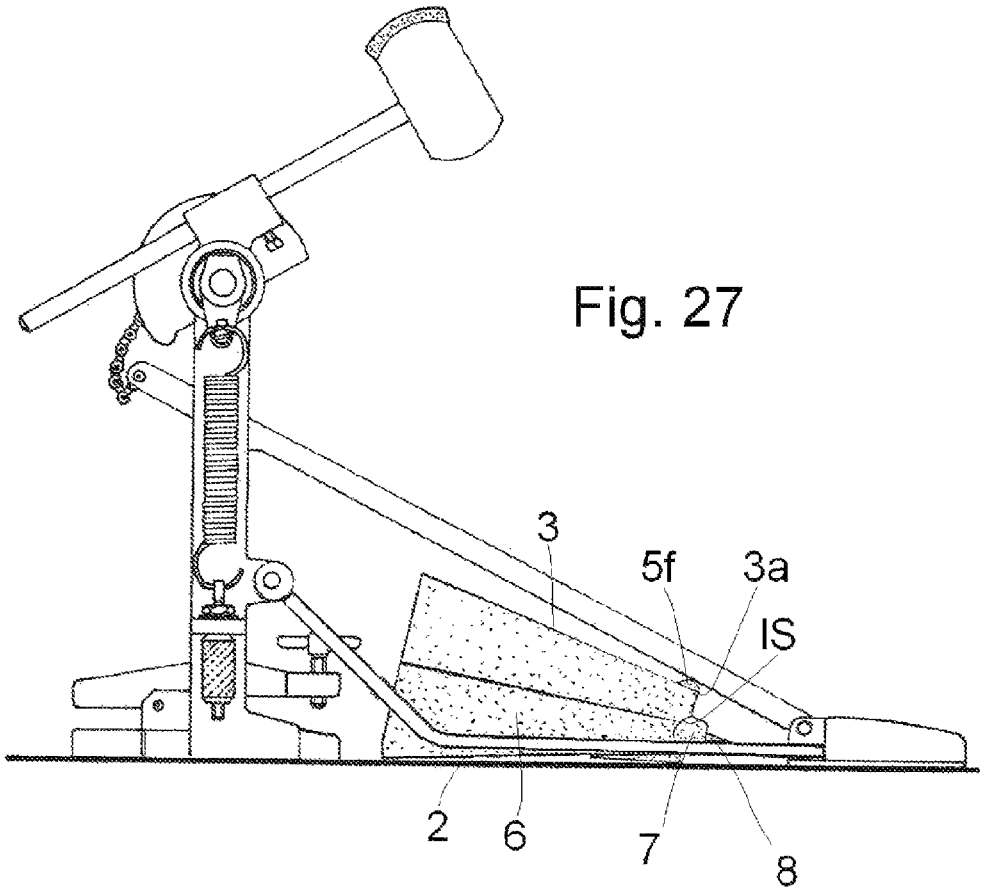
Figure 28:
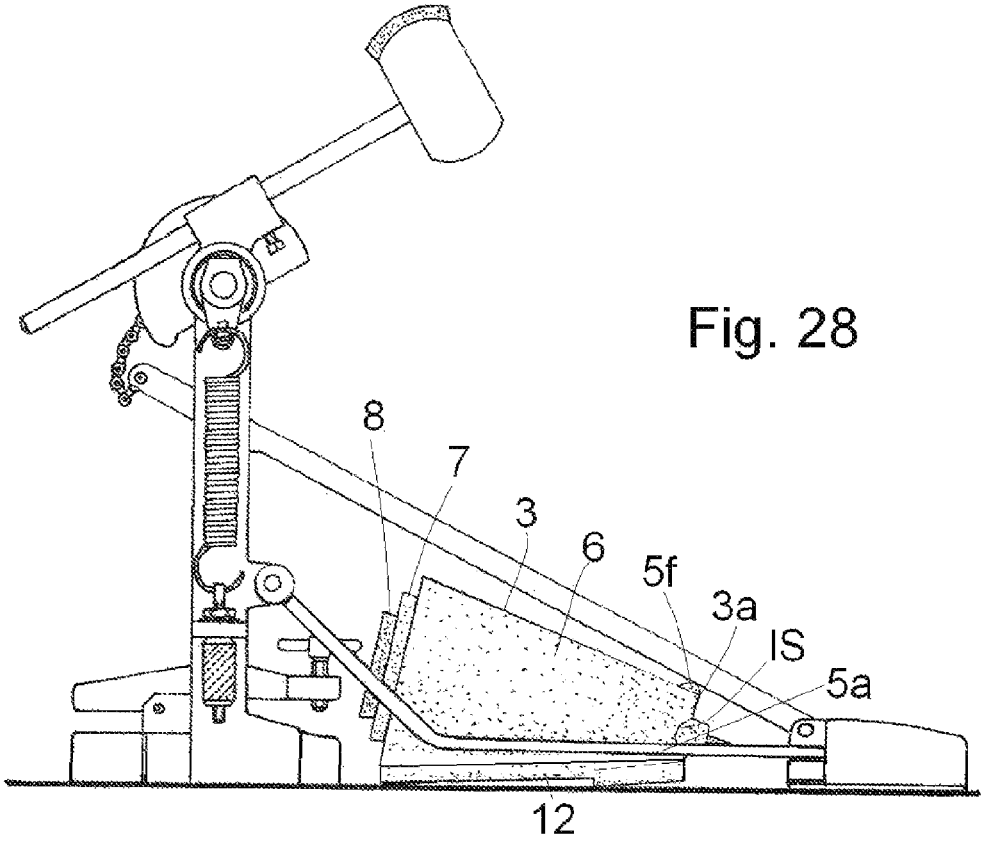
Figure 30:
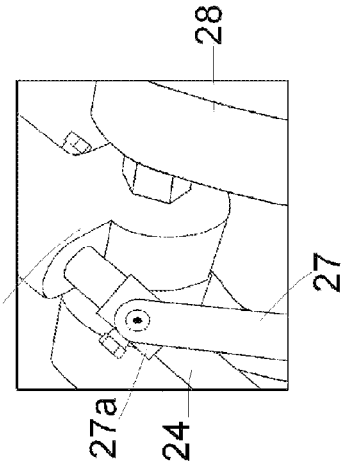
Figure 29:
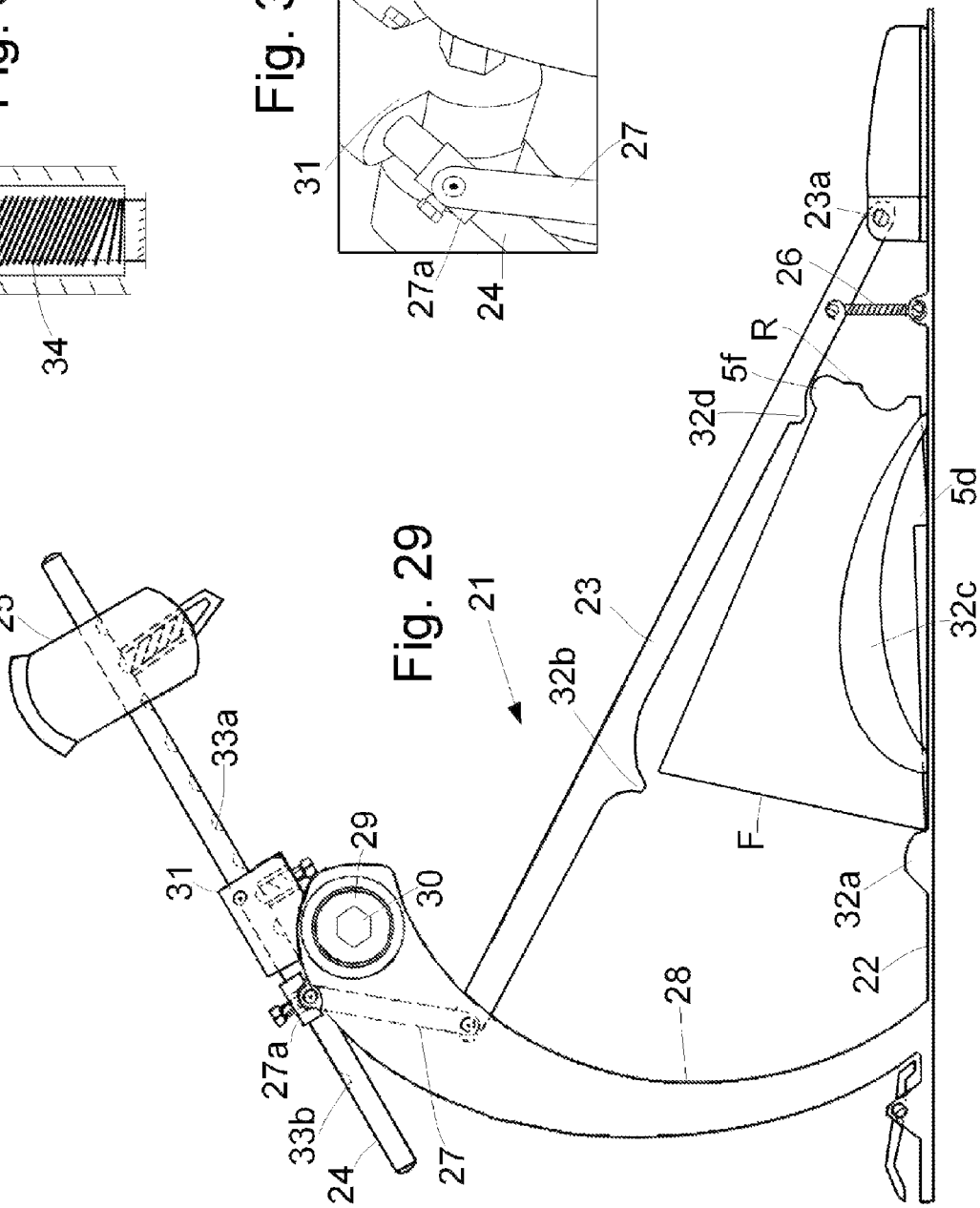

FIG. 25*a* is a view similar to FIG. 19 of another pedestal component embodiment;

FIG. 26 illustrates a series of mounting components according to the present invention;

FIG. 27 is a side view which illustrates an embodiment of a strengthening device according to the present invention arranged under a drum pedal, in which the relief portions are not compressed since the user has not yet put the weight of his foot on the pedal;

FIG. 28 is a view similar to FIG. 27 in which a strengthening device assembled with a pedestal component is arranged under a drum pedal;

FIG. 29 is a side view which illustrates an embodiment of a strengthening device according to the present invention arranged under a drum pedal according to the present invention;

FIG. 30 is an enlarged scale view of a detail of FIG. 29; and

Figure 31:
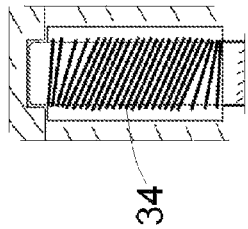

FIG. 31 is a sectional view of a detail of FIG. 29.

In the accompanying drawings, equivalent or similar parts or components were marked with the same reference numerals.

DETAILED DESCRIPTION OF THE INVENTION

Figure 1:
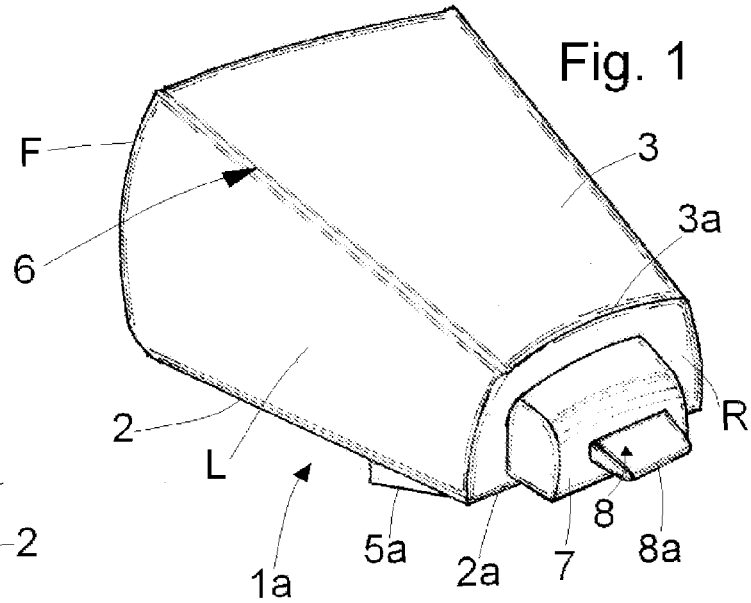
FIG. 1 is a perspective view slightly from above of a strengthening device according to the present invention.
Figure 2:
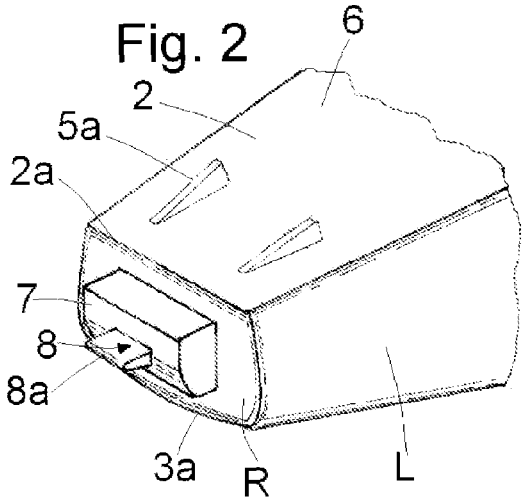
FIG. 2 is a perspective view slightly from the bottom of a detail of the strengthening device according to FIG. 1.

With reference to FIGS. 1 and 2, a leg muscle strengthening device 1*a* is illustrated which includes a support surface 2 and a work surface 3, articulated to each other at a respective articulation end 2*a*, 3*a*. The two surfaces can therefore be mutually angularly movable between at least one compression position and at least one release position. The support surface 2 is substantially flat, and advantageously also the work surface 3 is substantially flat. The work surface 3 is external, i.e. it is directly engageable by the foot of a user or by a plate of a drum pedal.

The device has a front F, a back R and two flanks L, the articulation end 2*a*, 3*a* being situated at the back R, while the cross section of a device according to the present invention decreases in the front F-to-back R direction.

The device also comprises one or more relief portions extending towards the device exterior starting from the support surface 2 and/or work surface 3, and being placed at the respective articulation end 2*a*, 3*a* in a manner such that it results proximal to the back R and distal from the front F.

According to the embodiment illustrated in FIGS. 1 and 2, the device has two relief portions 5*a* extending from the support surface 2, each at a respective flank L and articulation end 2*a*.

The relief portion/portions is/are made of elastically or resiliently deformable material and preferably has/have rough surface, so that in use it/they can be moved between an extended rest position and a compressed position close to a respective support surface 2 and/or work surface 3, in which it induces reaction forces that oppose the slipping of the device due to the horizontal component of the compression force applied to the device by a user. Such force is applied by a user directly or with the interposition of a drum pedal, when the support surface 2 and the work surface 3 are mutually angularly moved between at least one compression position and at least one release position.

Preferably, the relief portion/portions is/are made integrally with the respective support and/or work surface.

Advantageously, the thickness and/or height of the relief portion/portions varies in the front F-back R direction.

Preferably, the at least one relief portion extends from the back R for an extension of or equal to less than a half of a respective support 2 or work 3 surface, and still more preferably at least one relief portion has a thickness of or equal to less than a third of the thickness of the device at the back R.

In the illustrated embodiment, the relief portions 5*a* of FIG. 2 include substantially triangular longitudinal section elements, with height increasing in the back-to-front direction, thus having maximum height in a zone thereof that is distal from the back R of the device 1*a*.

Such device can include an external hollow tubular element 6, an insert element 7, it too tubular and hollow, perfectly insertable/extractable in/from the through opening delimitated by the external hollow body 6 and an insert component 8, in turn perfectly insertable/extractable in the/from the through opening delimited by the hollow insert element 7, in a manner such that an appendage or end of the insert component 8 projects from the hollow insert element 7 and can be grasped by a user.

As will be understood, a strengthening device according to the present invention can include an insert component 8 including an appendage or end 8*a* with high thickness, such that it can be grasped by the user in an easy and effective manner in order to be efficiently and correctly positioned.

One such strengthening device has relief portion/portions being extended from the external walls of the external hollow tubular body 6.

Preferably, the external hollow body 6, the hollow insert element 7 and the insert component 8 are tapered in the front F-to-back R direction, i.e. their cross section decreases in such direction.

The external hollow tubular body 6 preferably has notches or seats IS (see FIGS. 27 and 28 in particular) at the back R of the device, which are intended to allow easily grasping the hollow insert element 7 when this is inserted in the external hollow body 6.

Advantageously, the external hollow body 6 has two rounded side walls. Still more advantageously, the internal wall of the external hollow body and the external wall of the hollow insert element 7 have square or rectangular cross section with rounded corners or edges, respectively. With one such configuration, the contact portion between a corner of the internal wall of the body 6 and a respective edge of the hollow insert element will be wide and without interruption points, such that good relative anchoring will be obtained between the body 6 and the element 7. When the body 6 and the element 7 have one such configuration, they are provided with a high compressive strength and they are not subjected to localized tearing phenomena.

The internal walls of the body 6 or element 7 can include a receiving recess or slot (e.g. of several millimeters) designed to shape engage, upon assembling a device according to the present invention, with an embossed portion protruding from the external walls of the hollow insert element 7 and insert component 8, respectively, thereby improving the stability and further ensuring that the assembled elements are kept in position.

Moreover, the internal walls of the body 6 and element 7 can be slightly curved.

Figure 5:
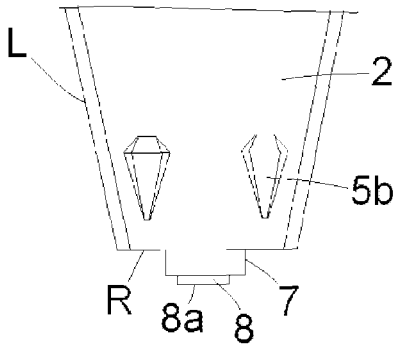
FIG. 5 is a bottom view of the strengthening device of FIG. 3.
Figure 4:
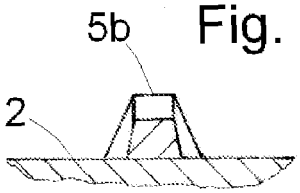
FIG. 4 is a cross-section view taken along the line IV-IV of FIG. 3.
Figure 3:
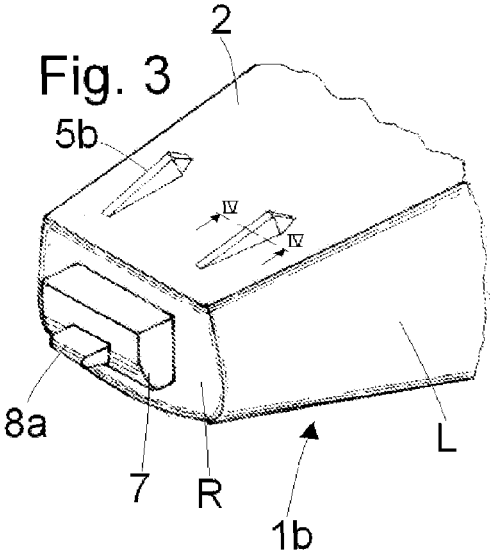
FIG. 3 is a view similar to FIG. 2, but regarding another embodiment of the strengthening device according to the present invention.

With reference to FIGS. 3 to 5, a device 1*b* is illustrated that is similar to the device 1*a*, but in which two relief portions 5*b* are provided for that have maximum thickness and height at an intermediate portion. The thickness and the height of the relief portion/portions gradually increases/increase in the back R-to-front F direction, and once a preferably maximum value is reached in a zone beyond the middle of the portion, they decrease. The walls of the relief portions are not perpendicular but oblique with respect to the support surface 2, and hence they are prearranged to be deformed when subjected to a force with a component orthogonal to the back R-to-front F direction; in such a manner, they are opposed to and limit a possible movement of the device.

In FIG. 6, a strengthening device 1*c* is illustrated which is provided with a relief portion 5*c* extending from a portion at the articulation end 2*a* of the support surface, from one flank L to the other of the device 1*c*. The relief portion 5*c* is substantially C-configured, with two sections 9*a* each parallel to a respective side of the device 1*c* and arranged at a respective flank L and a bridge connection section 9*b* between the two parallel sections 9*a*. The height of the two parallel sections 9*a* gradually increases in the back R-to-front F direction of the device 1*c*.

The strengthening device 1*c* preferably comprises adhesive means 10 placed at the support surface 2, which are extended from the back R towards the front of the device, preferably between one flank L on the back R of the device 1*c* and the other flank L at the front F of the device itself.

With reference to FIG. 7, a device 1*d* is illustrated that is similar to the device 1*c*, but provided with a relief portion 5*d* extending from one flank L to the other of the device 1*d* and which is configured as a ramp whose height increases in the back R-to-front F direction of the device 1*d*.

In FIG. 8, a strengthening device 1*e* is illustrated that is provided with relief portions 5*e* configured as substantially cylindrical pins extending from the support surface 2, each at a respective flank of the articulation end 2*a*. It will be understood that the relief portions 5*e* could also be differently configured, e.g. as hemispheres and preferably have rough surface.

With reference to FIGS. 9 to 16, 16*a*, and 16*b* respective embodiments of strengthening devices are illustrated according to the present invention.

Figure 9:
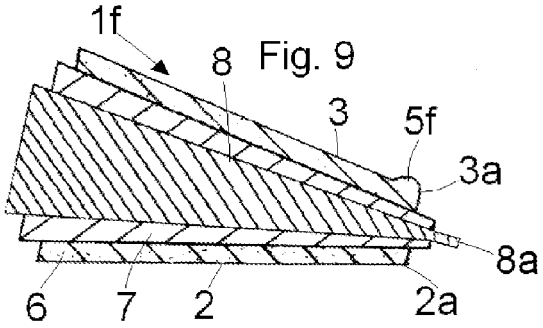
FIGS. 9 to 16 are longitudinal section views of the same number of embodiments of a strengthening device according to the present invention.
Figure 11:
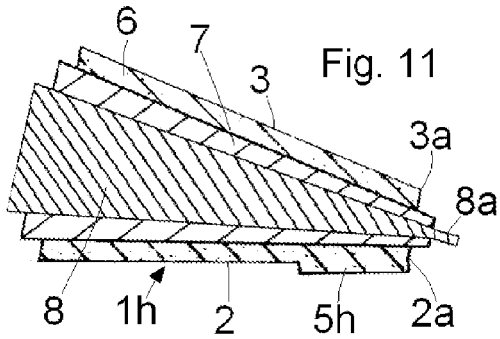
Figure 10:
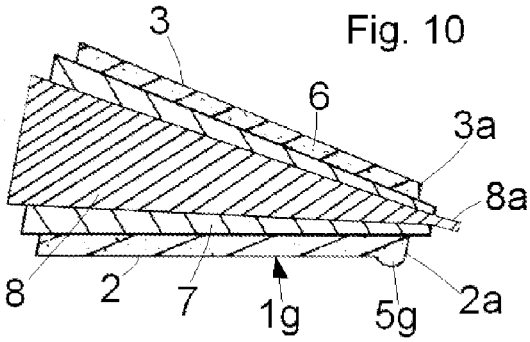
Figure 12:
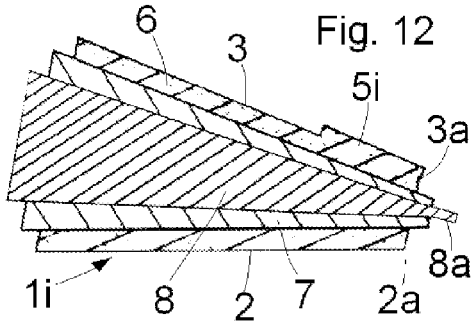
Figure 13:
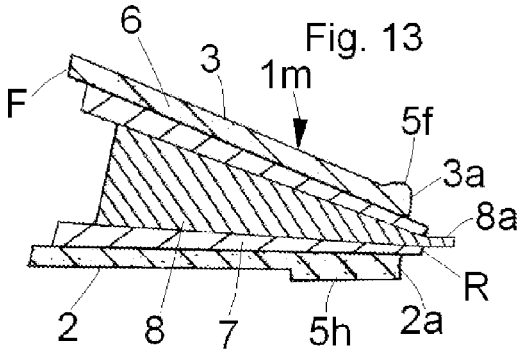
Figure 15:
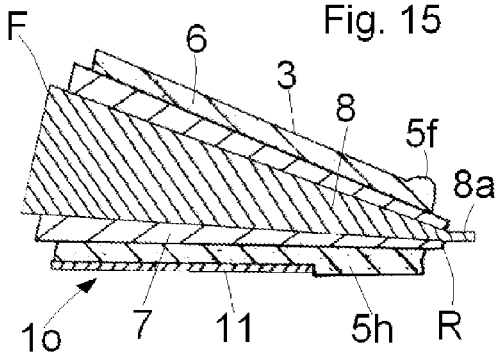
Figure 14:
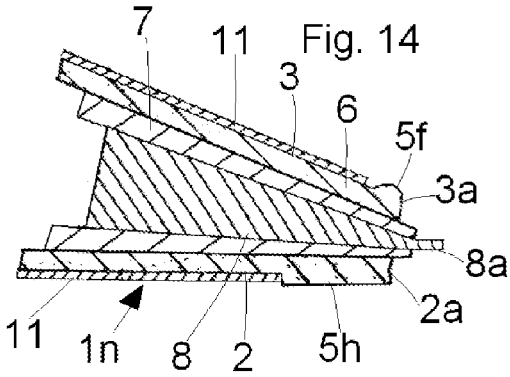
Figure 16:
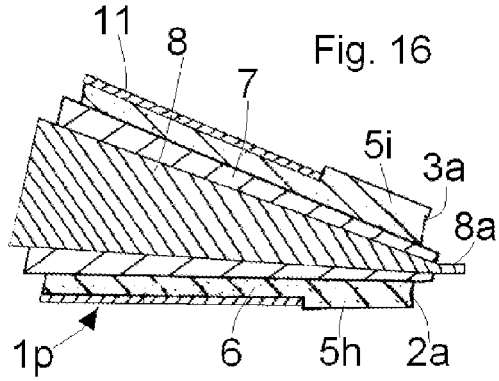

More particularly, the following are illustrated in such Figures:

- in FIGS. 9 and 10, strengthening devices 1*f* and 1*g*, including an embossed relief portion 5*f* and 5*g* extending, respectively, from the articulation end 3*a*, 2*a* of the work surface 3 and of the support surface 2;
- in FIGS. 11 and 12, strengthening devices 1*h* and 1*i*, which include a relief portion 5*h* and 5*i* being extended, respectively, from the articulation end of the support surface 2 and of the work surface 3; the relief portions 5*h* and 5*i* are configured as sheets having a top surface parallel to the respective support surface 2 or work surface 3, so as to have constant height in the back R-to-front F direction of the respective device 1*h* and 1*i;*
- in FIG. 13, a strengthening device 1*m* provided with an embossed relief portion 5*f* extending from the articulation end 3*a* of the work surface 3 and a sheet-configured relief portion 5*h* extending from the articulation end of the support surface 2; as will be observed, moreover, such device at the front end F thereof has the end of the external hollow body 6 projecting with respect to the hollow insert element 7, and the latter in turn projecting with respect to the insert 8, while at the back end R thereof, it has the insert 8 projecting with respect to the hollow insert element 7, and the latter projecting with respect to the external hollow body 6;
- in FIG. 14, a strengthening device 1*n* similar to the embodiment 1*m*, but provided with a layer of anti-slip material 11 applied on the support surfaces and work surfaces;
- in FIG. 15, a strengthening device 1*o* similar to the device 1*m*, but provided with a layer of anti-slip material 11 applied only on the support surface of the device; moreover, such device at the front F thereof has the insert 8 projecting with respect to the hollow insert element 7, and the latter projecting with respect to the external hollow body 6; and
- in FIG. 16, a strengthening device 1*p* similar to the device 1*n*, but equipped with a sheet-configured relief portion 5*i* and 5*h* respectively being extended from the articulation end of the work surface and support surface;
- in FIG. 16*a* a strengthening device 1*q* similar to the device 1*p*, but provided with a relief portion 5*b* extending from the articulation end of the work surface or the support surface; the two relief portions 5*b* can slightly differ in size and dimensions; and
- in FIG. 16*b* a strengthening device 1*r* provided with relief portion 5*b* projecting from the articulation end 3*a* of the work surface 3, and one or a pair of relief portions 5*a* extending from the articulation end of the support surface 2.

In such embodiments, an insert component 8 is illustrated including an appendage or end 8*a* parallel to the work surface (see FIGS. 9 to 12) or support surface (see FIGS. 13 to 16, 16*a*, and 16*b*).

With reference to FIGS. 17 to 22, a pedestal component 12 is illustrated that is intended to raise a strengthening device according to the present invention, so as to allow adapting the strengthening device to the characteristics of the user, and possibly to those of the pedal. The pedestal component 12 comprises a laminar body having two main surfaces 12*a*, 12*b*.

One 12*a* of the main surfaces of the pedestal component 12 has or delimits one or more reception seats 13 for a respective relief portion as defined above, while the relief portion/portions 14 similar to those of the above-described embodiments is/are extended from the other main surface 12*b* of the pedestal component 12.

The two walls 12*a*, 12*b* can be parallel to each other, or preferably slightly tilted with respect to each other.

More particularly, the two main surfaces 12*a*, 12*b* are connected by means of four perimeter surfaces: one front 15, one rear 16 and two lateral 17*a*, 17*b*. The rear surface 16 has a smaller area than the front surface 15.

The reception seat/seats 13 is/are made and the relief portion/portions 14 is/are extended at the rear surface 16.

Preferably, the relief portions 14 include:

- a wall 14*a* being extended from one lateral surface 17*a* to the other 17*b;*
- walls 14*b*, 14*c*, each being extended from the main surface 12*b* at an edge between the main surface 12*b* and a respective lateral surface 17*a*, 17*b*; preferably, each wall 14*b*, 14*c* has longitudinal axis substantially parallel to a respective lateral surface 17*a*, 17*b*.

Advantageously, the pedestal component 12 includes small pins 18, preferably two small pins 18, each rising from the surface 12*a* at a respective front edge. Still more advantageously, the pedestal component includes notches 18*a* for receiving the small pins. Each notch 18*a* is obtained from the surface 12*b* and is substantially aligned with a respective small pin 18.

According to the embodiment illustrated in FIGS. 23 and 24, the walls 14*b*, 14*c* have a respective truncated edge distal from the rear surface 16 and proximal to the respective lateral surface 17*a*, 17*b*.

The pedestal component 12 can also provide for adhesive means 19 placed at the surface 12*a* and/or 12*b*, which are extended from the front surface to the rear surface of the pedestal component 12.

In FIG. 25*a*, a pedestal component 120 is illustrated that is similar to the pedestal component 12. Here, though, in place of the wall 14*a* there is a wall 14*d* whose height decreases in the back R-to-front F direction and reaches its maximum at the back R of the component. The reception seat 13*a* is configured in a manner so as to receive a relief portion of a device according to the present invention or another pedestal component. For example, including wall 14*d* and walls 14*b*.

According to the present invention, a mounting unit is also provided for equipped with a pedestal component 12 and a strengthening device according to the present invention (see FIG. 26). Such component and device can be assembled together so as to raise the strengthening device with respect to a support plane, without however impairing its performances.

For the assembly, one arranges the surface 12*a* of the pedestal component 12 facing and substantially parallel to the support surface 2 of the device; then, these are brought close together or packed together in a manner such that the relief portion/portions of the strengthening device is/are inserted and is/are received in one or a respective reception seat 13.

If the pedestal component includes small pins 18, then respective blind holes 20 will be provided for in the strengthening device, obtained from the support surface. During the assembly of a strengthening device and pedestal component, such holes will receive respective small pins 18. Should the pedestal component 12 not be provided with adhesive means, the mutual engagement between a pedestal component and a device or between a first and a second pedestal component is obtained owing to the mutual engagement between blind holes 20 of the device and pins 18 of the pedestal component or between blind holes of the first pedestal component and pins of the second pedestal component.

It is also possible to assemble two pedestal components 12 together in a manner that is entirely similar to that described above (see FIG. 25). In such a manner, one can assemble a strengthening device with two or more assembled pedestal components; it is thus possible to further raise the level of the device, without however limiting its functional effectiveness. Advantageously, a mounting unit according to the present invention comprises a strengthening device and three pedestal components, which can have different thicknesses.

With reference to FIGS. 27 and 28, respective strengthening devices are illustrated according to the present invention, arranged under a drum pedal.

With particular reference to FIGS. 29 to 31, a strengthening device is illustrated according to the present invention beneath a drum pedal structure 21 which comprises a ground support footboard 22, an abutment plate 23 pivoted in 23*a* on the rear part of the footboard 22, a rod 24 which at its head bears a hammer or percussion element 25, and means for mechanically connecting the abutment plate 23 to the rod 24.

The structure then comprises an elastic or resilient return element 26, such as a spring fixed on one side to the abutment plate 23 and on the other side to the footboard 22, more particularly at the back of the pedal structure 21.

More particularly, in order to mechanically connect the abutment plate 23 to the rod 24, a shackle component 27 is provided for, on one end articulated to the front end of the abutment plate 23 and on the other end to the rod 24. Advantageously, the upper end of the shackle element 27 is articulated to a slide element 27*a* intended to slide and be fixed in position on the rod 24.

A bracket member is then provided for, e.g. curved 28, which rises from a front portion of the footboard 22; a pin is rotatably mounted in an upper end of such footboard, e.g. by means of a ball bearing 29, and preferably the pin 30 has a substantially orthogonal axis, and still more preferably it has a polygonal section, e.g. a hexagonal section. The pedal structure 21 then comprises a block element 31 which on one side is fixed to the pin 30 and on the other side can be removably connected to an intermediate portion of the rod 24.

A device according to the present invention can be housed in the reception zone delimited on one side by the lower surface (lower during use) of the footboard 22 and on the other side by the upper face (upper in use) of the abutment plate 23.

Advantageously, the pedal structure comprises one or more bosses or appendages 32*a*, 32*b* being extended from the lower surface (lower in use) of the footboard 22 and from the upper face (upper in use) of the abutment plate 23 and intended to engage, in use, respective portions on the front F of the device 1 so as to restrict it, delimiting its possible horizontal sliding. Moreover, lugs or bosses 32*d* can be provided which extend from the surface, in use, lower of the footboard 22 and/or from the face, in use, upper of the abutment plate 23 and are designed to engage, in use, respective relief portions of the device.

During the use of a strengthening device according to the present invention beneath a drum pedal 21, the compression force applied by the user to the abutment plate 23 will determine a stress force on the device including a vertical component (vertical in use) and a horizontal component (horizontal in use), the latter being able to cause a horizontal movement (towards the front of the pedal structure). As will be understood, the presence of bosses or appendages 32*a*, 32*b* in fact prevents such undesired movement.

Containment bands 32*c* can also be provided for, extending from lateral portions of the footboard 22 and intended to oppose lateral movements of said strengthening device in use.

According to a variant in accordance with the present invention, a series of positioning holes 33*a*, 33*b* are formed on the rod 24. In such holes, respective elastically or resiliently loaded pins are insertable (elastically loaded by means of a respective spring 34) and slidably mounted in the block element 31, in the hammer or percussion element 25 and in the slide element 27*a*. Preferably, the holes 33*a*, 33*b* are not through holes, while the pins have rounded or chamfered edges, e.g. about 45°, so as to facilitate their insertion in the respective hole.

As will be noted, when a strengthening device is arranged according to the present invention beneath a pedal, the relief portions that are extended from the support surface result in contact with the ground or support on which the pedal is arranged, while the relief portions which are extended from the work surface result in contact with the lower surface (lower in use) of the pedal.

Therefore, when a strengthening device according to the present invention is arranged beneath a pedal, it results in contact with the pedal and/or support at respective relief portions. Subsequently, the user repeatedly presses the pedal in order to carry out the training. Due to the presence of the relief portions, even when the user releases the pedal, there is never a complete detachment between the pedal, the device and the support, and thus the device remains correctly in work position during the training steps and hence use steps thereof. In use, the relief portions are in fact always pressed, mainly as a function of the weight of the foot; hence, the relief portions cause reaction forces which are opposed to the slipping of the device due to the horizontal component of the compression force applied by the user.

If one uses a device provided with relief portions having walls that are tilted with respect to each other, a reaction force can be obtained against device slipping with additional components, such to oppose both the longitudinal and transverse slipping of the device.

A training method according to the present invention therefore comprises the following steps:

- a device is prearranged according to the present invention;
- a pedal structure is prearranged according to the present invention;
- the device is placed in the reception zone delimited on one side by the upper surface (upper in use) of the footboard 22 and on the other side by the lower face (lower in use) of the abutment plate 23;
- the foot is rested on top of the abutment plate 23, so as to move (through the weight of the leg) the at least one relief portion between the extended rest position and the compressed position close to a respective support surface 2 or work surface 3 in which it induces reaction forces which are opposed to the device slipping; and the abutment plate 23 is sequentially pressed, so that the support surface 2 and the work surface 3 are angularly moved with respect to each other between the at least one compression position and the at least one release position, while the at least one relief portion remains permanently in the compressed position.

If the device includes one or more relief portions extending from the support surface 2 and one or more relief portion extending from the work surface 3, when the user's foot is located atop the abutment plate 23, either the relief portion extending from the support surface 2 and the relief portion extending from the work surface 3 is displaced from the extended rest position to the compressed position at the respective support surface 2 or work surface 3.

Moreover, it will be noted that, should a device according to the present invention be used under a drum pedal, after the pedal been pressed by the user, the device allows the pedal to return to its initial position, and thus it solves the function, which is usually accomplished by an elastic element (springs) located at the front of the pedal. To this regards, it will be noted that the spring 26 has the sole function of limiting possible oscillations of the footboards 22 during the return stroke to the initial position.

The device, in addition to being used together with a drum pedal, can also be used for medical-rehabilitation purposes.

A strengthening device according to the present invention can be made of an elastically deformable material, such as flexible polyurethane.

The device according to the present invention can be used in combination with any type of pedal. Preferably, the tilt angle between the work surface and the support surface is less than the angle which a pedal delimits with the ground during rest, and when the device is arranged beneath a pedal, the latter will engage a relief portion in rest position. In the initial work step, the device will undergo a deformation only at relief portions thereof; such relief portions will be deformed by means of the weight of the user's foot, which will then lock the strengthening device in position with respect to the ground, thereby the strengthening being ready to be used.

A device according to the present invention has a high practicality of use, in particular when it comprises an external hollow body and one or more inserts, which can be easily used and which by being mutually engaged allow the user to be able to adjust the mechanical characteristics of the device—even within a wide interval.

The pedestal components also allow adapting the device to any type of surface and use angle of a possible pedal.

The pedestal component has a density that is greater or equal to that of the respective device.

The external walls of the device, and possibly both the internal and external walls of the components of the device, such as the external hollow tubular body 6, the hollow tubular insert element 7 and the insert component 8, can have rough surfaces.

The external hollow tubular body 6, the hollow tubular insert element 7 and the insert component 8, when they have tapered configuration, can also be made such that the tubular insert element 7 has a slightly greater volume than the cavity delimited by the external hollow body 6, and the insert component 8 has a slightly greater volume than the cavity delimited by the tubular insert element 7. More particularly, the tubular insert element 7 has, at its front F, a cross-section which substantially corresponds to the cavity delimited by the hollow external body 6, and at its rear R a cross-section which is larger than the cavity delimited by the hollow external body 6, whereas the insert component 8 has, at the front F, a cross-section which substantially corresponds to the cavity delimited by the tubular insert element 7, and at the rear R a cross-section which is larger than the cavity delimited by the tubular insert element 7. In such case, when the hollow tubular element 7 is inserted in the hollow tubular body 6, and the insert component 8 is inserted in the hollow tubular element 7, high pressure must be applied to the insert element 7 and to the insert component 8 so as to cause their deformation and thus adaptation to the respective cavity in which they are inserted. It will be understood that the relative friction between components thus assembled will be sufficiently high to ensure the maintenance of the relative position of the components themselves in the position desired by the user.

In addition, as will be understood, by more or less inserting one component into the other, the compressive strength of the device is modified; hence, the above-indicated expedients ensuring the mutual maintenance in position of the components during their entire use period assure that the device maintains the compressive strength initially established by the user.

Also, a device according to the present invention:

is easily transportable, since it is very light and structurally deformable;

when made of elastic material, it is provided with optimal strength and thus is even capable of supporting quite strong impacts.

A device according to the present invention can also be made of a flexible material, even of a very soft material. In such case, when the device is used beneath a drum pedal, it facilitates the drummer in the release steps in which—after a beat step when the user has pressed the pedal, angularly moving it so as to position it substantially parallel to the ground—it brings the foot back into initial work position. As will be understood, during the release step, the device will press the pedal at the surface thereof that is opposite the foot contact surface, or opposite the user's shoe, favoring the return of such pedal in initial position, ready to be newly pressed by the user.

In addition, as will be understood, the device can be arranged beneath any drum pedal, and in addition it can be made of a material such as polyurethane, which can be cut with scissors or similar tools; the device can thus be adapted to any pedal type, even by the user himself.

The strengthening device described above is susceptible to numerous modifications and variants within the protective scope of the present invention as defined by the claims.

Thus, for example, the work surface can be configured in a manner such to ergonomically receive the user's foot.

The device can also include only one external hollow body and one hollow insert element insertable/disconnectable therein, hence without an insert component insertable in the hollow insert element, and in addition such elements can be integrally made or made from several parts.

Advantageously, elements such as plates having different densities with respect to the components of the device (e.g. the external hollow body 6, the hollow insert element 7 and the insert component 8) can be inserted in the device. Such elements can, for example, be made of rigid plastic material so as to allow greater adaptability to user needs and greater tear strength; such tears can be caused by the sharp, repeated deformations to which the device is subjected.

While the invention has been described in connection with certain presently preferred embodiments thereof, those skilled in the art will recognize that many modifications and changes may be made therein without departing from the true spirit and scope of the invention which accordingly is intended to be defined solely by the appended claims.

The invention claimed is:

1. A device for strengthening leg muscles having:

a substantially flat support surface and an external work surface directly engageable by the foot of a user or by a plate of a drum pedal, said support and work surfaces being articulated with each other at a respective articulation end, so that they can be mutually and angularly moved between at least one compression position and at least one release position, and a front, a back and two flanks, the cross section of said device decreasing in the front-to-back direction, said articulation end being arranged at the back, said strengthening device comprising at least one relief portion at said articulation end thereby resulting proximal to said back and distal from said front, said at least one relief portion:

extending towards the exterior of said device from at least one between said support surface and said work surface, being made integrally with the respective support surface or work surface, and and being made of resiliently deformable material, whereby said at least one relief portion is movable between an extended rest position and a compressed position close to a respective support surface or work surface, in which it induces reaction forces which are opposed to the device slipping due to the horizontal component of the compressive force applied to said device by a user, directly or with the interposition of a drum pedal, when said support surface and said work surface are mutually angularly moved between at least one a compression position and at least one release position.

2. A device as claimed in claim 1, wherein said at least one relief portion extends from said back for an extension of or equal to less than a half of a respective support surface or work surface.

3. A device as claimed in claim 1, wherein said at least one relief portion has a thickness of or equal to less than a third of the thickness of said device at said back.

4. A device as claimed in claim 1, wherein the height of said at least one relief portion varies in the front-to-back direction.

5. A device as claimed in claim 1, wherein the thickness of said at least one relief portion varies in the front-to-back direction.

6. A device as claimed in claim 5, wherein said thickness is maximum at an intermediate part of the respective relief portion.

7. A device as claimed in claim 1, wherein said at least one relief portion extends from one flank to the other of said device.

8. A device as claimed in claim 1, wherein it comprises an external hollow body, at least one hollow insert element insertable in said external hollow body, and at least one insert component, insertable in said hollow insert element, whereby an appendage thereof projects from said hollow insert element and can be grasped by a user.

9. A device as claimed in claim 8, wherein said external hollow body has notches or seats at the back of said device, intended to allow easily grasping said hollow insert element.

10. A device as claimed in claim 1, wherein it comprises adhesive means at said support surface.

11. A device as claimed in claim 10, wherein said adhesive means extends from said articulation end of said support device towards the front of said device.

12. The device of claim 1, comprising a mounting unit, including at least one pedestal component including two main surfaces, at least one relief portion extending from at least one of such surfaces.

13. A unit as claimed in claim 12, wherein said pedestal component delimits at least one reception seat for a respective relief portion of said strengthening device.

14. A unit as claimed in claim 12, wherein said main surfaces are tilted with respect to each other.

15. The device of claim 1, comprising a drum pedal structure, the pedal structure including:

a ground support footboard, an abutment plate pivoted on the rear of the footboard, a rod which at its head bears a hammer or percussion element, and means for operatively connecting said abutment plate to said rod, said device being housed in the reception zone delimited on one side by the lower surface, lower in use, use of the footboard and on the other side by the upper surface, upper in use, of the abutment plate.

16. A pedal structure as claimed in claim 15, wherein said means for mechanically connecting comprise:

a shackle component articulated both to said abutment plate and to said rod, a bracket member rising from a front portion of said footboard, a pin rotatably mounted in an upper end thereof, and a block element which on one side is fixed to said pin and on the other side is removably connected to an intermediate portion of said rod.

17. A pedal structure as claimed in claim 15, comprising an elastic return element fixed on one side to said abutment plate and on the other side to said footboard.

18. A pedal structure as claimed in claim 15, comprising at least one boss or appendage extending from the lower surface, lower in use, of said footboard and from the upper face, upper in use, of said abutment plate and intended to engage, in use, respective portions on the front of said device thereby restricting it to delimit its possible horizontal sliding.

19. A pedal structure as claimed in claim 15, comprising containment bands extending from lateral portions of said footboard and intended to oppose lateral movements, lateral in use, of said strengthening device.

20. A pedal structure as claimed in claim 16, wherein, on said rod, a plurality of holes are formed in which respective elastically loaded pins are insertable, such pins being slidably mounted in at least one from among the block element, the percussion element and a slide element articulated to said shackle element.

21. A training method which provides for the following steps:

prearranging a device having:

a substantially flat support surface and an external work surface directly engageable by the foot of a user or by a plate of a drum pedal, said support and work surfaces being articulated with each other at a respective articulation end, so that they can be mutually and angularly moved between at least one compression position and at least one release position, and a front, a back and two flanks, the cross section of said device decreasing in the front-to-back direction, said articulation end being arranged at the back, said strengthening device comprising at least one relief portion at said articulation end thereby resulting proximal to said back and distal from said front, said at least one relief portion extending towards the exterior of said device from at least one between said support surface and said work surface, and being made integrally with the respective support surface or work surface, and being made of resiliently deformable material;

prearranging a pedal structure having a ground support footboard, an abutment plate pivoted on the rear of the footboard, a rod which at its head bears a hammer or percussion element, and means for operatively connecting said abutment plate to said rod, said device being housed in the reception zone delimited on one side by the lower surface, lower in use, use of the footboard and on the other side by the upper surface, upper in use, of the abutment plate;

placing said device in the reception zone delimited on one side by the upper surface, upper in use, of said footboard and on the other side by the lower face, lower in use, of said abutment plate;

resting the foot on top of the abutment plate, so as to move said at least one relief portion between said extended rest position and said compressed position close to a respective support surface or work surface in which it induces reaction forces that are opposed to the slipping of said device; and sequentially pressing said abutment plate, such that said support surface and said work surface are angularly moved with respect to each other between said at least one compression position and said at least one release position, while said at least one relief portion remains permanently in said compressed position.

22. A method as claimed in claim 21, wherein said device includes at least one relief portion extending towards the exterior of said device from said support surface and at least one relief portion extending towards the exterior of said device from said work surface, and wherein when the user's foot is located atop the abutment plate, either the relief portion extending from said support surface and the relief portion extending from said work surface are displaced from the extended rest position to said compressed position at the respective support surface or work surface.

* * * * *